United States Patent [19]

Forsyth

[11] Patent Number: 4,593,855

[45] Date of Patent: Jun. 10, 1986

[54] VEHICLE-MOUNTABLE FIRE FIGHTING APPARATUS

[75] Inventor: Robert W. Forsyth, Upland, Calif.

[73] Assignee: Vehicle Systems Development Corporation, Upland, Calif.

[21] Appl. No.: 573,334

[22] Filed: Jan. 24, 1984

[51] Int. Cl.[4] ..... A62C 27/18

[52] U.S. Cl. ..... 239/74; 169/24; 239/175

[58] Field of Search ..... 169/24, DIG. 1; 239/71, 239/74, 99, 148, 170, 172, 175, 176; 73/306

[56] References Cited

U.S. PATENT DOCUMENTS

| | | | |
|---|---|---|---|
| 1,322,359 | 11/1919 | Shelly | 239/172 |
| 1,663,484 | 3/1928 | Pierce | 73/306 |
| 2,044,039 | 6/1936 | Woodcock | 239/172 |
| 2,206,329 | 7/1940 | Olson | 73/306 |
| 2,241,857 | 5/1941 | Hisaw | 169/24 |
| 2,525,372 | 10/1950 | Riddell | 239/175 |
| 2,533,772 | 12/1950 | De Frees | 169/24 X |
| 2,663,590 | 12/1953 | Wyatt | 239/74 |
| 2,810,606 | 10/1957 | Taylor | 239/71 |
| 3,375,875 | 4/1968 | Wesson | 169/9 |
| 3,770,060 | 11/1973 | Forsyth et al. | 169/24 |
| 4,252,274 | 2/1981 | Kubacak | 239/170 |
| 4,410,045 | 10/1983 | Whitman | 169/24 |

FOREIGN PATENT DOCUMENTS

| | | | |
|---|---|---|---|
| 352785 | 7/1931 | United Kingdom | 169/24 |

OTHER PUBLICATIONS

"Developing a Fire-Fighting Pumper Pack for Army Trucks", Trailer/Body Builders, Sep. 1974, pp. 50–54.

"Condor Attack System", Western Fire Equipment Company advertisement.

*Primary Examiner*—Jeffrey V. Vase

*Attorney, Agent, or Firm*—Robbins & Laramie

[57] ABSTRACT

The invention provides a modular fire fighting apparatus which may be quickly and easily mounted onto an ordinary pickup truck, and conveniently operated by the vehicle driver from the cab of the vehicle. The module generally includes a pump coupled to an engine for pumping a fire-retardant liquid, a control means for regulating the amount of liquid pumped, and a reservoir tank fluidly connected to the pump. The frame of the apparatus both unitizes the pump, engine and tank, and positions the engine and pump controls within the reach of the operator when the operator is in the cab of the vehicle. The invention further includes a tank level indicator including a transparent conduit and an elongated float engaged onto a guide rod in the tank for providing a visual display of the tank level which is positioned so that it may be observed through the rear-view mirror of the truck. Finally, the invention includes an over-the-cab hose which may be detachably coupled onto a spray bar mounted onto the front of the truck.

10 Claims, 6 Drawing Figures

VEHICLE-MOUNTABLE FIRE FIGHTING APPARATUS

FIELD OF THE INVENTION

This invention generally concerns an improved apparatus for distributing a fire-retardant liquid which is detachably mountable onto an operator-driven vehicle.

BACKGROUND OF THE PRIOR ART

Modular fire fighting units which may be installed onto an unmodified cargo truck are known in the prior art. Such units can economically convert an ordinary cargo truck into an effective fire fighting unit in a relatively short period of time. The fire fighting unit provided by such a device provides a very useful supplement to conventional, "metropolitan" fire trucks, which are necessarily few in number at any particular time due to their expense, and the limited resources of the localities which purchase and maintain them.

However, such prior art modular fire fighting units are not without shortcomings. For example, many of them are too large to be installed on popular, low-cost commercial pickup trucks. Additionally, the controls of such prior art modules can only be operated from the cargo area or bed of the truck, and not from the cab area, thus rendering a mobile assault on brush or grass fires difficult, if not impossible, for a single vehicle operator to accomplish. The weight associated with such prior art modules makes it difficult to transport in light-duty aircraft. Finally, the location of the fire hoses in the cargo area of the truck further hampers the ability of the vehicle operator to make a mobile "frontal assault" on a fire while in the cab of the vehicle.

Clearly, a need exists for a self-contained, fire fighting module which can easily convert a low-cost, popular model pickup truck into a fire truck capable of mounting a mobile, frontal assault on a fire. Additionally, in order to maximize the cost-effectiveness of such units, it would be desirable if such a module could serve purposes other than fighting fires, such as the distribution of decontamination chemicals, insecticides or fertilizers.

SUMMARY OF THE INVENTION

In its broadest sense, the invention is an improved appratus for distributing a liquid which may be a fire-retardant liquid of the type which is detachably mountable onto an operator-driven vehicle. The invention includes a pump coupled to an engine for pumping the liquid, a control means for regulating the amount of liquid pumped, and a reservoir tank fluidly connected to the pump.

The invention may include a frame for unitizing the pump, engine and tank, and for positioning the control means within the reach of the vehicle operator through the rear cab window of the vehicle when the apparatus is mounted on the cargo area of the vehicle. The frame may include means for detachably mounting the apparatus within the cargo area of a vehicle, such as an ordinary pickup truck, which includes bolts and joggles which fit into the stake pockets of the truck. The frame may further include at least one detachably mountable step for facilitating access to the apparatus. Finally, the frame may include vibration-absorbing means for insulating the reservoir tank from the vibration generated by the pump and engine, and for mounting the various components of the invention in a space-minimizing, rectangular configuration.

The invention may further include a visual display for indicating the fluid level in the tank. The visual display may include a transparent conduit, and an elongated float engaged to a guide rod within the reservoir tank which is observable by an operator sitting in the cab of the vehicle. The conduit of the visual display may also function as a fill tower, and may include a fill vent.

Finally, the apparatus of the invention may include an over-the-cab feed line detachably coupled to a spray bar mounted onto the front of the cab, as well as a rear feed line detachably coupled to a spray bar mounted on the rear of the vehicle.

BRIEF DESCRIPTION OF THE SEVERAL FIGURES

DETAILED DESCRIPTION OF THE PREFERRED EMBODIMENT

A. General Overview of the Apparatus of the Invention

Figure 1:
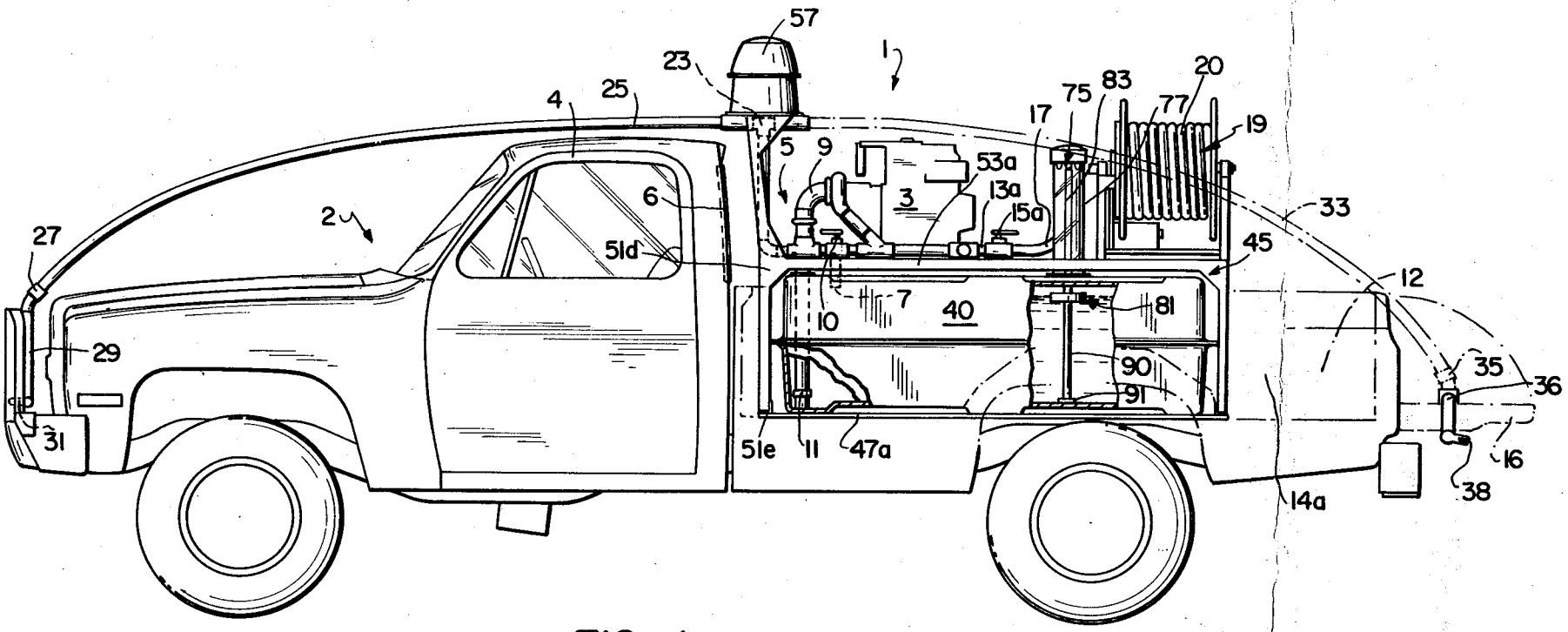
FIG. 1 is a partial cross-sectional side view of the apparatus of the invention as it would appear detachably mounted onto a pickup truck.
Figure 2:
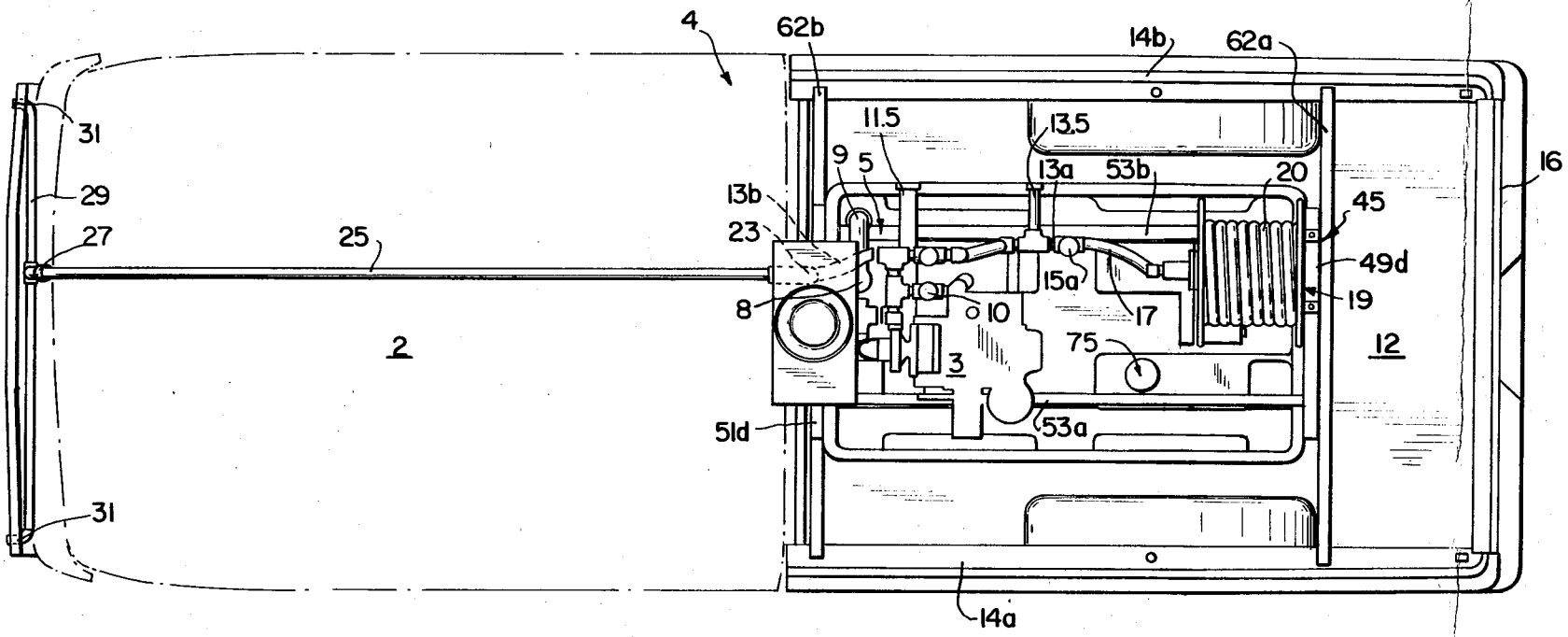
FIG. 2 is a plan view of the apparatus of FIG. 1.

With reference now to FIGS. 1 and 2, wherein like numerals designate like parts, the invention is a self-contained fire fighting module 1 which is detachably mountable upon an operator-driven vehicle, such as an ordinary pickup truck. The module 1 is particularly adapted for use on a pickup truck 2 having a cab portion 4 with a sliding rear cab window 6, and a cargo area including a flat bed 12 surrounded by a pair of sidewalls 14*a*, 14*b* and a tailgate 16. Preferably, the side walls 14*a*, 14*b* of the truck 2 each include at least two stake pockets 18*a*, 18*b*, 18*c* and 18*d*, respectively. All of the foregoing features, including the rear cab window 6, are available on standard model trucks manufactured by AMC Jeep, Chevrolet, Dodge, Ford and GMC. As will presently be seen, one of the advantages of the module 1 of the invention is that it requires no structural modifications on such standard model trucks.

Figure 4:
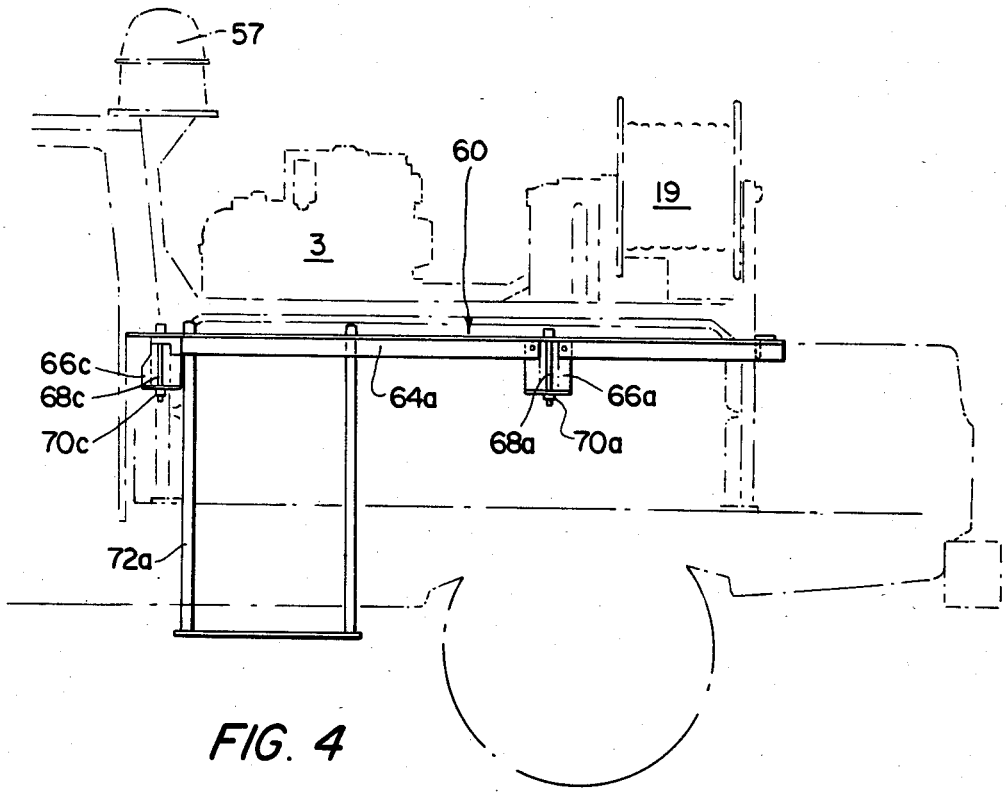
FIG. 4 is a side view of the mounting frame which detachably mounts the apparatus of the invention onto a pickup truck.
Figure 5:
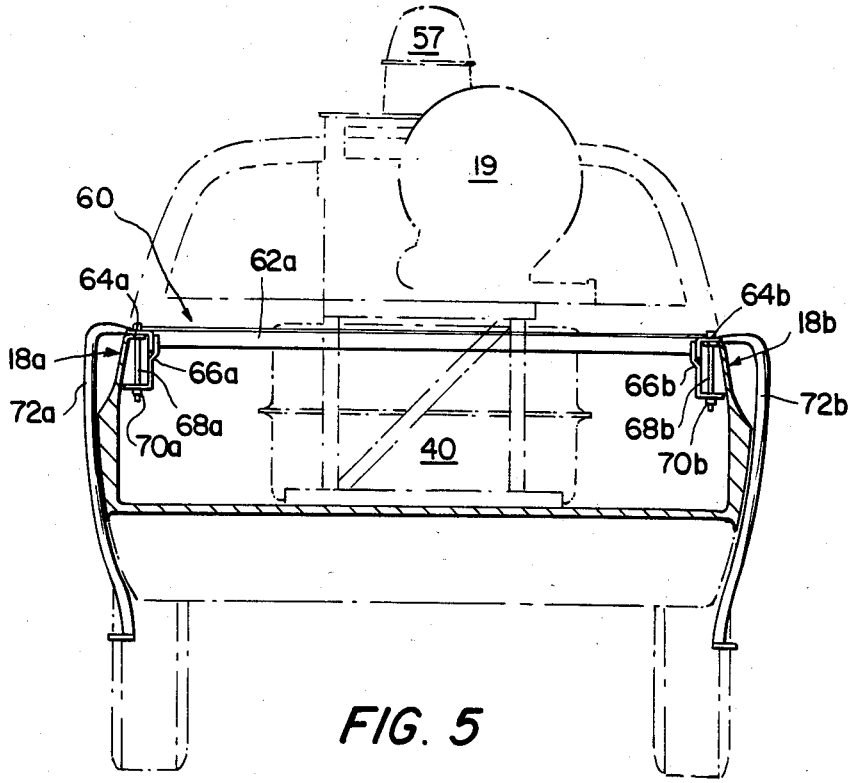
FIG. 5 is a back view of the frame of FIG. 4.

The module 1 generally comprises a pump/engine combination 3 which is fluidly connected to a reservoir tank 40 and selectively connectable to either the high pressure hose wound on reel 19, or an over-the-cab feed line 25. The output of the pump/engine combination 3 may be manually regulated by a plurality of controls 5, which include an adjustable throttle (not shown) on the engine, a pump return line valve 10, and a pair of pump outlet valves 15*a*, 15*b*. The module 1 further includes a high-strength, unitizing frame 45 which positions the controls 5 along the side of the module 1, which faces the rear cab window 6 when the module 1 is detachably mounted in the flat bed 12 of the truck 2. The unitizing frame 45 also mounts all of the various components 3, 5, 19 and 40 in a generally rectangular configuration in order to minimize the space requirements of the module 1. With reference now to FIGS. 4 and 5, the invention preferably also includes a mounting frame 60 connected to the unitizing frame 45. Mounting frame 60 detachably mounts the module 1 into the bed 12 of the truck 2 through the stake pockets 18*a*, 18*b*, 18*c* and 18*d* of the truck 2 in a manner which will be described in more detail hereinafter. Finally, as may best be seen in FIG. 6, the invention includes a fill tower and vent assembly 75 which includes a float 81. The fill tower 77 itself is formed from a transparent material, and houses a sleeve 83 which is integrally connected to the float 81. As will be described in more detail hereinafter, the fill tower and vent assembly 75 provides a visual indication of the level of the liquid inside the reservoir tank 40 to a vehicle operator sitting in the cab portion 4 of the vehicle 2.

B. Specific Description of the Apparatus of the Invention

With reference back to FIGS. 1 and 2, the pump of the pump/engine combination 3 is a model No. 20FD-B25 high-pressure centrifugal pump manufactured by the Hale Fire Pump Company of Conshohoken, Pa. The engine of the pump/engine combination 3 is preferably a Briggs & Stratton 11-horsepower, 25CID air-cooled gasoline engine with an integral 6-quart fuel tank. The engine/pump combination 3 includes an adjustable throttle and exhaust primer (not shown) which is positioned near the end of the module 1 facing the rear cab window 6 of the truck 2. Such positioning allows the vehicle operator to control the speed with which the pump/engine combination 3 operates through the rear cab window 6 while stting in the cab portion 4 of the truck 2. The performance range of the aforementioned pump/engine combination 3 is between eighty-two gallons per minute at fifty psi and twenty gallons per minute at two hundred sixty psi. It should be noted that the pump/engine combination 3 is mounted across the two top angle irons 53*a*, 53*b* of the unitizing frame 45. These angle irons 53*a*, 53*b* bridge over the reservoir tank 40 and thereby isolate the tank 40 from the vibration generated by the pump/engine combination 3, thus avoiding the tank stress failures which could otherwise occur if the tank 40 were exposed to such vibration. To further eliminate any problems associated with such vibration, the pump/engine combination 3 is secured to the unitizing frame 45 with conventional vibration dampers (not shown), and all intake and discharge lines between the pump/engine combination 3 and the tank 40 are connected with flexible couplings.

The pump/engine combination 3 is fluidly connected to the reservoir tank 40 by means of a pump inlet pipe 9. The pump inlet pipe 9 terminates in an anti-swirl suction line 11 of conventional design. The mouth of the anti-swirl suction line 11 is preferably located in the right-hand corner (from the vehicle operator's perspective) of the tank 40 along the bottom edge closest to the cab portion 4 of the truck 2. Such positioning allows the suction line 11 to drain all of the fire-retardant liquid in the tank 40 along both the longitudinal and transverse axes. Longitudinal drainage in the tank 40 occurs as a result of the slightly "nose-down" orientation that most trucks assume when no load is present across their rear axles. Hence, as the pump/engine combination 3 empties the tank 40 of more and more of the fire-retardant liquid contained therein, the rear axle of the truck 2 experiences less and less of a load, and consequently tips the nose of the truck 2 at a provessively downward angle. Similarly, the positioning of the anti-swirl suction line 11 in the right-hand corner of the reservoir tank 40 cooperates with the slight curbside tilt that the crown of most roads gives to vehicles, and drains the tank 40 along its transverse axis. It should be noted that tank 40 also includes a hydrant fill line 11.5 located on the curb side of the module 1 which allows the tank to be conveniently filled from a hydrant or other source of water. Fill line 11.5 includes a fill valve 8 for regulating the pressure of the water pumped into the reservoir tank 40.

The outlet side of the pump/engine combination 3 includes a pair of outlet pipes 13*a*, 13*b* connected together by way of a T-joint which terminates in discharge outlet 13.5, which is normally capped. Outlet pipe 13*a* is connected to a length of high pressure hose 20 wound on hose reel 19 via flexible coupling 17. An outlet valve 15*a* controls the flow of liquid from outlet pipe 13*a* to high pressure hose 20. In the preferred embodiment, high-pressure hose 20 is ¾" I.D. multi-purpose, high-pressure booster hose. Additionally, reel 19 is preferably a conventional, electric rewind reel of the type which includes a small electric motor which drives the reel 19 through a chain and sprocket drive. In the preferred embodiment, the electric motor which drives the reel 19 is connected to the electrical system of the host vehicle 2. High-pressure hose 20 preferably terminates in a lightweight nozzle (again not shown) capable of delivering 10 to 20 gallons/min. ranging from effective fire fighting streams to a range of fog patterns. Pump outlet pipe 13*b* is coupled to the over-the-cab feed line 25 via valve 15*b* (not shown) and T-joint coupling 23 as indicated. The feed line 25 is coupled to a front-mounted spray bar 29 via coupling 27. The spray bar 29 includes a plurality of nozzles 31 which are pivotable along a variety of angles so that the spray bar is capable of delivering a spray or fog of a fire-retardant liquid anywhere from parallel to 90° relative to the ground. In the alternative, spray bar 29 may be coupled to pump outlet pipe 13*b* by a feed line (not shown) mounted under the cab portion 4 of the truck 2. The location of the controls 5 of the module near the cab window 6, in combination with the provision of a spray bar 29 in the front portion of the truck 2, makes it possible for one man to execute a mobile attack on brush and grass fires without leaving the cab of the vehicle. It should be noted that coupling 27 and T-joint coupling 23 are both quick-disconnect couplings, and that the over-the-cab feed line 25 may be utilized for drafting water from ponds, swimming pools, or other available water sources by manipulating the valves forming the controls 5 of the pump/engine combination 3.

Between the inlet and the outlet side of the pump/engine combination 3 is a pump return line 7 which includes a return line valve 10 as shown. When valve 10 is open, and the pump outlet valves 15*a*, 15*b* are closed, the pump/engine combination 3 will circulate the liquid contained in the reservoir tank 40 quickly and rapidly through the tank. This feature is particularly useful when the module 1 is used as a decontamination apparatus in the cleaning of hazardous chemical and toxic materials spills. The decontamination agents can be introduced through fill tower and vent assembly 75 while the tank is being filed from a hydrant or other source of water through hydrant fill line 11.5. Rapid and thorough mixing is easily accomplished by recirculating the water and agent through the pump return line 7. The pivotable nozzles 31 in front-mounted spray bar 29 make it easy to wash down buildings, vehicles, paved surfaces and open areas.

Optionally, the module 1 of the invention may include a rear feed line 33. Like the over-the-cab feed line 25, rear feed line 33 is connected to T-joint coupling 23 at one end, and to its own spray bar 36 at the other end via a quick-disconnect coupling 35. Spray bar 36, like spray bar 29, includes a plurality of nozzles 38 which may be pivotally oriented at any angle between 0° and 90° to the ground. Rear feed line 33 is particularly useful when the module 1 is used for spraying insecticides or other agricultural liquids, and allows such liquids to be sprayed onto crops while the vehicle operator remains in the cab portion 4 of the truck 2. In the preferred embodiment, spray bar 36 is a generally U-shaped member which is detachably mounted onto the tailgate 16 of the truck 2 in the manner indicated in FIG. 1.

The reservoir tank 40 of the module 1 is preferably either a one hundred or two hundred gallon heavy-duty tank formed from non-corrosive fiberglass. In order to dampen the motion of the liquid contained therein during a fire fighting operation, the tank 40 is preferably divided into six baffled compartments. The baffles (not shown) resemble the liquid dividers used in ice trays, and are likewise formed from fiberglass. There are two advantages associated with the use of a tank of all-fiberglass construction. First, the use of fiberglass in lieu of other, more conventional materials such as steel decreases the overall weight of the module 1, while complementing the function of the unitizing frame 45 in maintaining the strength of the module 61. The low weight and high strength of the module 1 in turn allows it to be quickly and conveniently airlifted by a variety of conventional, light-duty aircraft to its final destination. Secondly, because fiberglass is inert to most liquids, the tank 40 may be used to house liquids far more corrosive than water, such as insecticides, fertilizers, and various kinds of foaming, fire-retardant chemicals.

The frame of the module consists of two components, including a high strength unitizing frame 45 which mounts all of the various components 3, 5, 19 and 40 into a generally rectangular configuration, and a mounting frame 60 which detachably mounts the unitizing frame 45 of the module 1 to the stake pockets 18*a*, 18*b*, 18*c* and 18*d* present on the side walls 14*a*, 14*b* of the truck 2.

Figure 3:
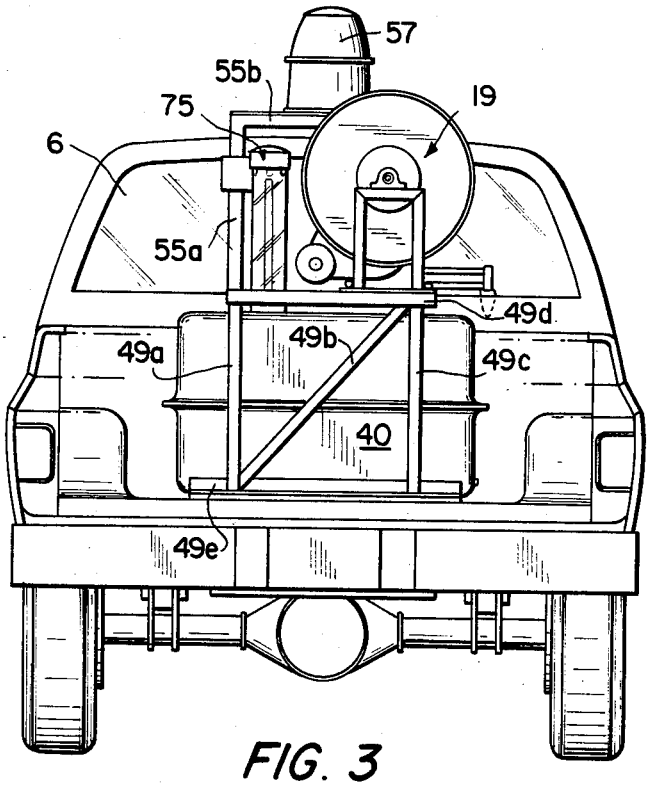
FIG. 3 is a back view of the apparatus of FIG. 1, shown without a mounting frame.

The unitizing frame 45 is formed from a rectangular array of angle irons which are preferably welded together at their joints. As may best been seen in FIG. 3, the rear portion of the unitizing frame 45 includes five angle irons 49*a*, 49*b*, 49*c*, 49*d* and 49*e*. Angle irons 49*a*, 49*c* are vertically disposed, while angle iron 49*b* diagonally connects the lower end of angle iron 49*a* with the upper end of angle iron 49*c*. Angle iron 49*d* is supported above the upper edge of the reservoir tank 40 by the vertically disposed angle irons 49*a* and 49*c*, while angle iron 49*e* runs along the bottom of the reservoir tank 40 as shown. Although not shown in any of the several figures, the cab-side portion of the unitizing frame 45 includes five angle irons arranged in the same configuration as the tail-side angle irons illustrated in FIG. 3.

Turning back now to FIGS. 1 and 2, unitizing frame 45 further includes a pair of parallel angle irons 53*a*, 53*b* which are connected to angle iron 49*d* of the tail-side of the frame 45, and angle iron 51*d* of cab-side angle irons 51*a*, 51*b*, 51*c*, 51*d* and 51*e*. It is important to note that the top angle irons 53*a* and 53*b* "bridge over" the reservoir tank 40. Since the pump/engine combination 3 is mounted onto the top angle irons 53*a*, 58*b*, the bridging configuration of these top angle irons 53*a*, 53*b* over the reservoir tank 40 isolates the tank from the normal vibration it would otherwise experience if the pump/engine combination 3 were directly mechanically coupled onto it. As previously mentioned, such isolation insulates the tank 40 from stress which could otherwise damage it.

In order to complete the generally rectangular configuration of the unitizing frame 45, a pair of bottom angle irons 47*a*, 47*b* which generally parallel the top angle irons 53*a*, 53*b* are welded onto angle iron 49*e* and its cab-side complement 51*e*.

With reference now to FIGS. 2, 4 and 5, the frame of the module 1 preferably includes a mounting frame 60 for detachably mounting the unitizing frame 45 onto the stake pockets 18*a*, 18*b*, 18*c* and 18*d* of the side walls 14*a*, 14*b* of the truck 2. The mounting frame 60 generally includes a pair of transverse angle irons 62*a*, 62*b* (best seen in FIG. 2), and a pair of side angle irons 64*a*, 64*b* (best seen in FIG. 4). The transverse angle irons 62*a*, 62*b* are welded onto the top angle irons 49*a*, 49*b* of the unitizing frame 45. The side angle irons 64*a*, 64*b* (which are inverted) are mounted across the ends of the transverse angle irons 62*a*, 62*b* on either side of the truck 2. Side angle irons 64*a*, 64*b* include holes (not shown) which are registrable with the stake pockets 18*a*, 18*b*, 18*c* and 18*d* of the truck 2. Slip-over joggles 66*a*, 66*b*, 66*c* and 66*d* are utilized at each of the four junctions between the angle irons 64*a*, 64*b* and the truck 2 to compensate for the dimensional differences in the stake pockets of various makes of trucks. Each of the joggles 66*a*, 66*b*, 66*c* and 66*d* have holes which are registrable with the top opening and drain hole of its respective stake pocket 18*a*, 18*b*, 18*c* and 18*d*. When the mounting brackets and the stake holes are properly registered, the module 1 is detachably mounted onto the truck by means of mounting bolts 68*a*, 68*b*, 68*c* and 68*d* threadedly engaged to mounting nuts 70*a*, 70*b*, 70*c* and 70*d*. The transverse angle irons 62*a*, 62*b* and the side angle irons 64*a*, 64*b* securely mount the unitizing frame 45 in the cargo space 12 of the truck 2 along both the transverse and longitudinal axis of the truck 2. Additionally, the transverse angle irons 62*a*, 62*b* coact with the positioning of the controls 5 of the pump/engine combination 3 in the unitizing frame 45 to bring these controls 5 within reach of the vehicle operator through the cab window 6, making it possible for the vehicle operator to stay in the cab portion 4 of the truck while operating the module 1. In case the truck 2 has no rear cab window 6, the mounting frame 60 further includes a pair of detachable steps 72*a*, 72*b* for facilitating access to the controls 5 of the pump/engine combination 3. Although not shown in any of the illustrations, the steps 72*a*, 72*b* are detachably mountable onto the side angle irons 64*a*, 64*b* by means of conventional quick-release lock pins.

Figure 6:
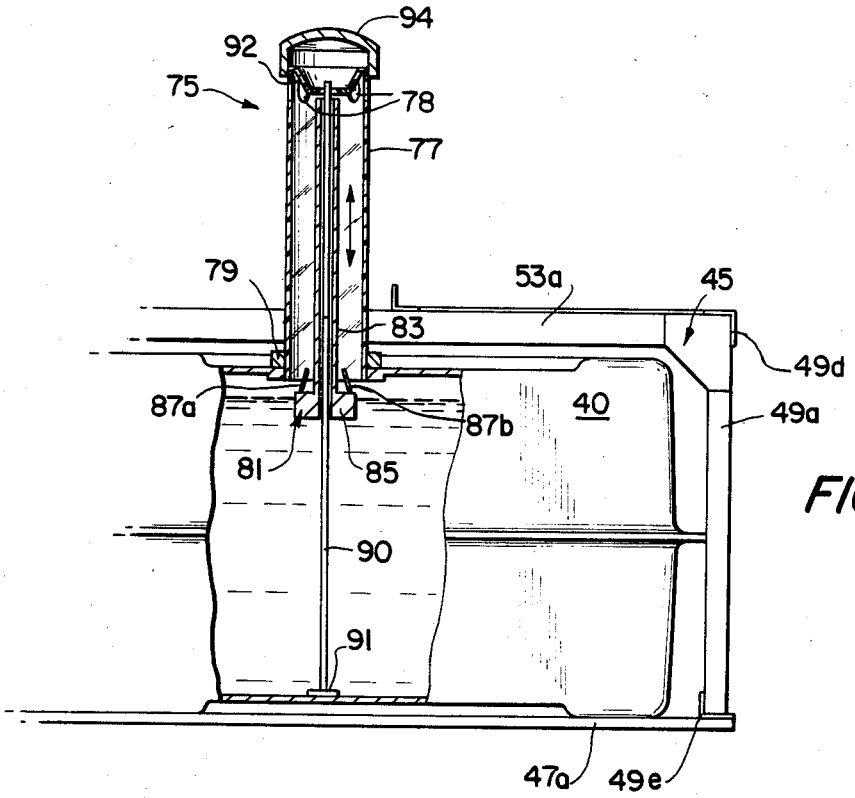
FIG. 6 is a side and cross-sectional view of the fill tower and vent assembly of the invention.

With reference now to FIG. 6, the fill tower and vent assembly 75 of the invention generally comprises a transparent cylinder 77 having a plurality of air vent ports 78 at its upper portion, a float 81, and a guide rod 90 for guiding the float 81. The top of the transparent cylinder 77 (which is preferably formed from an inert plastic) includes a strainer 92 for filtering out chunks of foreign matter in the liquid poured into the reservoir tank 40. The base of the transparent cylinder 77 is coupled to the reservoir tank 40 in fluid-tight relationship via sealing ring 79. The guide rod 90 is connected to the bottom of the reservoir tank 40 by means of guide rod anchor 91, and the top of the guide rod is inserted through a centrally disposed hole in the strainer 92. The float 81 of the assembly 75 includes two portions which are integrally connected, including a disc 85 with a centrally disposed hole, and a sleeve 83 which is preferably brightly colored so that the vehicle operator may easily tell at a glance the approximate level of the liquid within the reservoir tank 40. The guide rod 90 is inserted through both the hole in the disc 85, and through the hollow center of the sleeve 83 as shown, so that the float 81 moves vertically in accordance with the level of liquid in the reservoir tank 40. The top surface of the disc 85 includes at least two float stop valves 87*a*, 87*b* for preventing the disc 85 of the float 81 from blocking the bottom of the cylinder 77 when the tank 40 is filled to capacity. Finally, the top of the cylinder 77 is crowned with a blow-off cap tower cap 94 which protects the tank from rupturing when it is about to be subjected to an over-pressure condition either from filling too quickly or from over-filling. When the tank is being filled too quickly through hydrant fill line 11.5, blow-off cap 94 augments the function cylinder 77, thereby completely opening the mouth of the cylinder. When the tank is about to be over-filled and hence subjected to the 90 to 120 psi present in most water mains, the vanes 87*a*, 87*b* prevent the disc 85 of the float 81 from blocking the opening through the cylinder 77, and again allow cap 94 to blow off.

The fill tower and vent assembly 75 is preferably mounted on top of the reservoir tank 40 in the position indicated, for two reasons. First, such a location allows the operator of the truck 2 to easily see what the fluid level is in the reservoir tank 40 through the rear-view mirror of the truck when the truck is in motion. Secondly, such positioning allows the operator of the module 1 to easily visually monitor the liquid level in tank 40 from a variety of positions around the truck.

Finally, the module 1 of the invention may include an emergency lamp 57 mounted onto a U-shaped support formed from three angle irons 55*a*, 55*b* and 55*c* which are bolted onto the traverse angle iron 62*b* of the mounting frame 60. Emergency light 57 is preferably detachable connectable to the electrical system of the host vehicle.

Although the present invention has been described in this patent application with reference to a preferred embodiment, it should be understood that the invention is not limited to the details thereof. A number of possible substitutions and modifications have been suggested in the foregoing detailed description, and others will appear to those of ordinary skill in the art. All such substitutions and modifications are intended to fall within the scope of the invention as defined in the appended claims.

What is claimed is:

1. A liquid-distributing module which is detachably mountable onto an operator-driven vehicle having a cab and a cargo hold, comprising:

(a) a storage tank for storing a supply of liquid;

(b) a pump for creating a flow of said liquid;

(c) an engine which is separate from a vehicle engine for powering the pump;

(d) a control means for regulating the distribution of said liquid from said tank, including an adjustable throttle for controlling the power output of the engine, and a valve for controlling the flow of liquid out of the tank, and (e) a frame assembly which is detachably mountable onto a pre-existing portion of the cargo hold of the operator-driven vehicle for both unitizing and protecting said storage tank, pump, engine and control means, and for positioning said control means adjacent the vehicle cab, within reach of the vehicle operator, said frame assembly including a unitizing frame for unitizing the storage tank, pump, engine and control means in a compact configuration, and for positioning the control means substantially along one side of the resulting configuration, and a mounting frame connected to the unitizing frame for detachably connecting the unitizing frame to the cargo hold of the operator-driven vehicle with the control means adjacent the cab of the vehicle.

2. The liquid-distributing module of claim 1, wherein said cargo hold of said vehicle is defined by walls having stake pockets, and wherein said mounting frame further includes means for detachably mounting said mounting frame to said walls by said stake pockets.

3. The liquid-distributing module of claim 2, wherein said detachable mounting means includes joggles and bolts attachable to said stake pockets.

4. The liquid-distributing module of claim 1, wherein said mounting frame includes at least one detachable step.

5. A liquid-distributing module which is detachably mountable onto an operator-driven vehicle having a cab and a cargo hold, comprising:

(a) a storage tank for storing a supply of liquid;

(b) a pump for creating a flow of said liquid;

(c) an engine which is separate from a vehicle engine for powering the pump;

(d) a control means for regulating the distribution of said liquid from said tank, including an adjustable throttle for controlling the power output of the engine, and a valve for controlling the flow of liquid out of the tank, and (e) a frame assembly which is detachably mountable onto a pre-existing portion of the cargo hold of the operator-driven vehicle for both unitizing and protecting said storage tank, pump, engine and control means, and for positioning said control means adjacent the vehicle cab, within reach of the vehicle operator, and (f) a frame assembly including a unitizing frame formed from a rectangular array of structural members for unitizing, enclosing and protecting the storage tank, pump, engine and control means in a substantially rectangular configuration, wherein the control means is positioned along one side of the rectangle, and a mounting frame for detachably connecting the unitizing frame to a pre-existing portion of the cargo hold of the operator-driven vehicle with the control means adjacent the cab of the vehicle.

6. The liquid-distributing module of claim 5, wherein the unitizing frame has a separate support means for the engine and pump in order to isolate the storage tank from the vibrations generated by the engine and pump.

7. The liquid-distributing module of claim 6, wherein said separate support means includes a pair of support members which bridge over the storage tank.

8. The liquid-distributing module of claim 5, wherein said carbon hold of said vehicle is defined by walls having stake pockets, and wherein said mounting frame further includes means for detachably mounting said mounting frame to said walls by said stake pockets.

9. The liquid-distributing module of claim 8, wherein said detachable mounting means includes joggles and bolts attachable to said stake pockets.

10. The liquid-distributing module of claim 5, further including a transparent conduit which houses a float means and extends substantially vertically from the storage tank for providing a visual indication of the liquid level in the storage tank, as well as a means to fill said tank.

* * * * *